US005925262A

United States Patent [19]

Choi et al.

[11] Patent Number: 5,925,262

[45] Date of Patent: Jul. 20, 1999

[54] PLASMA DISPLAY PANEL AND METHOD OF FABRICATING THE SAME

[75] Inventors: Nak-Heon Choi; Do-Young Ok; Jin-Man Kim, all of Kyoungki-do; Deuk-Soo Pyun, Seoul, all of Rep. of Korea

[73] Assignee: Hyundai Electronics Industries Co., Ltd., Kyoungki, Rep. of Korea

[21] Appl. No.: 08/840,525

[22] Filed: Apr. 21, 1997

[30] Foreign Application Priority Data

May 22, 1996 [KR] Rep. of Korea ..... 96-17389

[51] Int. Cl.[6] ..... B44C 1/22

[52] U.S. Cl. ..... 216/24; 216/5; 216/39; 216/18

[58] Field of Search ..... 216/5, 18, 39, 216/23, 24; 438/608, 609; 313/584, 585, 586; 349/139

[56] References Cited

U.S. PATENT DOCUMENTS 5,247,227 9/1993 Park ..... 313/584
5,340,491 8/1994 Enomoto et al. ..... 216/23 X

FOREIGN PATENT DOCUMENTS 35-3143-248 12/1978 Japan ..... 216/23
8511126 11/1996 Japan .

*Primary Examiner*—William Powell
*Attorney, Agent, or Firm*—Ware, Fressola, Van Der Sluys & Adolphson LLP

[57] ABSTRACT

A plasma display panel is disclosed including: a transparent insulating substrate; a plurality of transparent electrodes in a strip arrangement with each electrode having a groove that runs along the median of its surface and has a predetermined width and depth at its center, and side walls on both sides of the groove, the side walls serving as barrier ribs; a fluorescent layer formed in each groove; and a plurality of electrodes in strip arrangement having a predetermined distance between one another and perpendicular to the transparent electrodes, the electrodes being supported by supporting means formed on a predetermined portion of barrier rib located on the edge portion of the substrate.

9 Claims, 3 Drawing Sheets

PLASMA DISPLAY PANEL AND METHOD OF FABRICATING THE SAME

BACKGROUND OF THE INVENTION

1. Field of the Invention

The present invention relates to a plasma display panel and a method of fabricating the same, and in particular, to a plasma display panel having barrier ribs arranged in a dense formation, with uniformly formed surfaces and a method of fabricating the same.

2. Discussion of Related Art

FIG. 1 shows a cross-sectional view of a conventional plasma display panel. Referring to FIG. 1, a plasma display panel, which displays pictures using gas discharge, includes two flat panels, a front substrate 1 and a back substrate 2, respectively. The edge portions of the substrates are sealed, and a large amount of gas is contained between the two substrates having a predetermined distance therebetween. Anodes 3 are formed on the inner surface of the front substrate 1 and cathodes 4 are formed on the inner surface of the back substrate 2. The anodes 3 and cathodes 4 are formed in a strip arrangement, and arranged in perpendicular fashion to each other. Barrier ribs 5 are formed on the front substrate 1 between anodes 3, to define the pixels of a plasma display and prevent crosstalk between neighboring pixels.

The resolution of the aforementioned plasma display panel depends on the inner structure between the front and back substrates, the kind of gas contained between the substrates, the shape and material of the cathode, and the degree of flatness of the barrier rib's surface coming into contact with the front substrate. In particular, the degree of flatness of the barrier rib's surface is crucial, because the barrier rib prevents the diffusion of light between neighboring pixels when they are discharged during the operation of the display panel.

Methods of forming the barrier rib include a screen printing method, a transfer method, and a sand blasting method.

With the screen printing method, a substrate is covered by a mask, a mucous material is then coated thereon and a burning process is carried out, to thereby form the barrier rib. The screen printing may be performed several times in order to control the height of the barrier rib. It is, however, difficult to form the barrier rib with great accuracy over a wide panel using the screen printing method because the mesh used in forming the mask can be warped.

In case of the transfer method, a mask pattern is formed on a substrate, and a material used for barrier ribs is continuously coated on the pattern, to thus form the barrier ribs. This method cannot be applied in the manufacture of SVGA HDTV display panel due to limits in pattern resolution.

With the sand blasting method, a material for barrier rib is uniformly coated on a substrate, and a protective layer acting as a mask is then formed on the barrier rib material. Next, the exposed portions of the barrier rib material are removed using a sand blaster and the protective layer is afterwards removed to thus form the barrier ribs. In this method, however, as the hard small grains used by the sand blaster strongly collide with the barrier rib material in order to cut the unnecessary portions, the small grains also strongly collide against the protective layer with such a force that portions of the protective layer are displaced against the surface of the barrier rib causing damage. Thus, a uniform surface of the barrier ribs is not obtained.

Accordingly, for the purpose of easily cutting the portions without damaging the protective layer or anode and cathode electrodes, new electrode material and protective layer material needs to be developed.

SUMMARY OF THE INVENTION

Accordingly, the present invention is directed to a plasma display panel and a method of fabricating the same that substantially obviates one or more of the above problems due to limitations and disadvantages of the related art.

An object of the present invention is to provide a plasma display panel and a method of fabricating the same, which forms barrier ribs densely and uniformly and prevents the barrier ribs from warping.

To accomplish the object of the present invention, there is provided a method of fabricating a plasma display panel, including the steps of: forming a plurality of first transparent electrode patterns in a strip arrangement on a transparent insulating substrate; selectively etching the first transparent electrode patterns, to form a second transparent electrode patterns each electrode of which has a groove running along the median of its surface and having a predetermined width and depth; forming red, green and blue fluorescent layers on the grooves; forming a sacrificial layer to a predetermined thickness on the overall surface of the substrate; forming a through hole in a predetermined edge portion of the sacrificial layer, to expose a portion of the substrate; depositing an electrode material on the overall surface of the sacrificial layer including the through hole so as to sufficiently bury the through hole; selectively etching the electrode material layer, to form an electrode pattern arranged perpendicular to the second transparent electrode pattern, the electrode pattern including an electrode material portion buried in the through hole; and removing the sacrificial layer.

The present invention provides a plasma display panel including: a transparent insulating substrate; a plurality of transparent electrodes arranged in stripes and with each electrode having a groove that runs along the median of its surface and has a predetermined width and depth, and side walls at either side, the side walls serving as barrier ribs; a fluorescent layer formed in each groove; and a plurality of electrodes in strip arrangement having a predetermined distance therebetween and arranged perpendicular to the transparent electrodes, the electrodes being supported by supporting means formed on a predetermined portion of barrier rib located on the edge portion of the substrate.

It is to be understood that both the foregoing general description and the following detailed description are exemplary and explanatory in nature and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Figure 1:
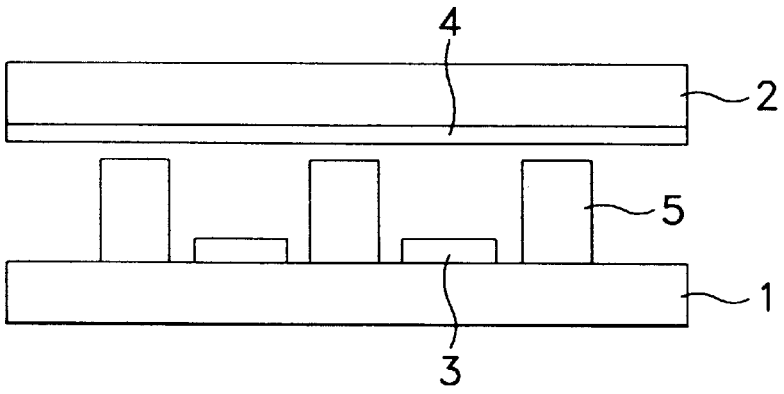
FIG. 1 PRIOR ART
FIG. 1 is a cross-sectional view of a conventional plasma display panel.
Figure 2A:
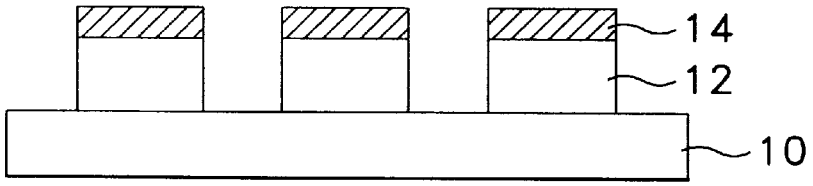
FIGS. 2A to 2E are cross-sectional views showing a method of fabricating a plasma display panel according to the present invention.

Referring to FIG. 2A, in the preparation to fabricate a plasma display panel, there is provided a top transparent glass substrate (not shown) and a bottom transparent glass substrate 10. A transparent conductive material such as indium tin oxide (ITO), and first photoresist layer (PMMA) are sequentially formed to a predetermined thickness on the transparent glass substrate 10. The first photoresist layer is selectively exposed and developed through a conventional photolithography technique, to form a first photoresist mask pattern 14. An exposed portion of the transparent conductive material layer is etched through an anisotropic dry-etching using first photoresist mask pattern 14 as a mask so as to expose the surface of substrate 10, to thereby form first transparent electrodes 12.

Figure 2B:
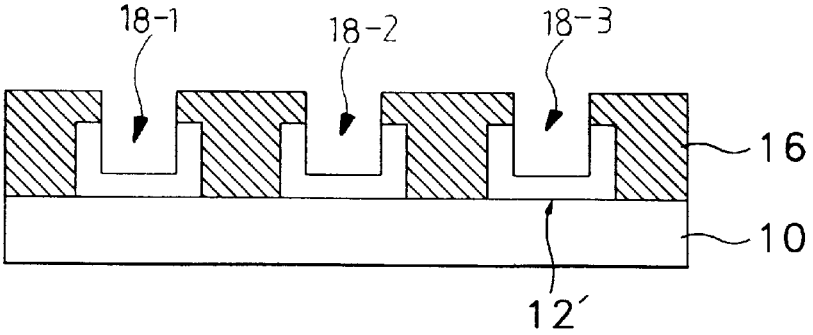

Referring to FIG. 2B, the first photoresist pattern 14 is removed, and a second photoresist layer is coated to sufficiently bury portions between first transparent electrodes 12. A portion of the second photoresist layer, which covers a predetermined portion of electrode 12, is selectively removed through a conventional photolithography, to form a second photoresist mask pattern 16. An exposed portion of electrode 12 is selectively etched to a predetermined depth and width through an anisotropic dry-etching using plasma, to thereby form second transparent electrodes 12' having grooves 18-1, 18-2 and 18-3 that run along the median of each electrode's surface.

Figure 2C:
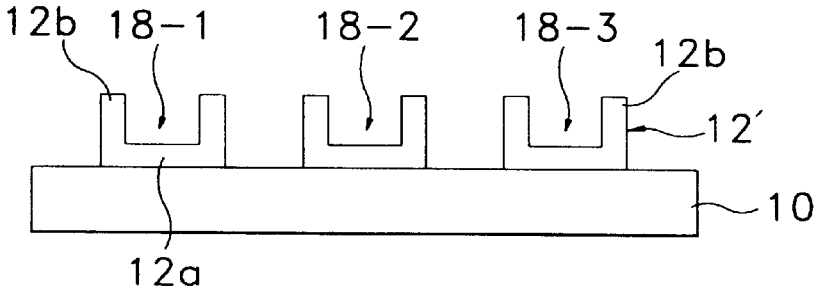
Figure 2D:
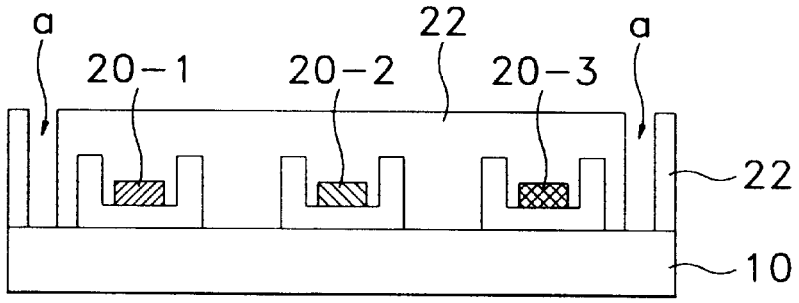

Referring to FIG. 2C, second photoresist pattern 16 is removed. The bottoms 12*a* of grooves 18-1, 18-2 and 18-3 of second electrodes 12' serve as vertical electrodes (anodes), and side walls 12*b* placed on both sides of the grooves serve as barrier ribs. Referring to FIG. 2D, a red fluorescent material is coated on the overall surface of the substrate including second electrode 12', and selectively etched through the conventional photolithography, to thereby form a red fluorescent layer 20-1 on a predetermined portion of vertical electrode 12*a* located in left from the viewpoint of figure. Through the same method, green and blue fluorescent layers 20-2 and 20-3 are sequentially formed on a predetermined portion of vertical electrodes 12*a* located in center and right, respectively.

Thereafter, in order to obtain a discharge space in each pixel region defined by barrier rib 12*b* and horizontal electrode which will be formed in the following process, a sacrificial layer 22 of polyimide is formed on the overall surface of the substrate. A predetermined portion of layer 22 is selectively etched so as to expose a portion of substrate 10, to thereby form through holes (a). Through hole (a) is formed where the horizontal electrode (cathode) and substrate 10 come into contact with each other. Through holes (a) are located on the edge portion of the substrate, having a predetermined distance from vertical electrodes 12*a*, and the horizontal electrode will run on the through holes.

Figure 2E:
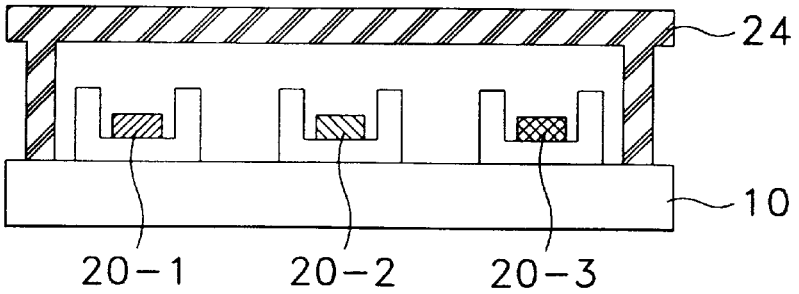

Referring to FIG. 2E, an electrode material such as aluminum is deposited on sacrificial layer 22 including through holes (a), and patterned through the conventional photolithography, to thereby form horizontal electrodes 24 in strip arrangement, perpendicular to the transparent vertical electrode 12*a*. The sacrificial layer 22 is removed through a wet-etching, to thereby form a gas discharge space between the vertical and horizontal electrodes. In addition, a bottom panel of the plasma display panel is formed as a result of the above step. The top transparent substrate (not shown), covers the bottom panel, and the top and bottom substrates are sealed at their edge portions.

Figure 3:
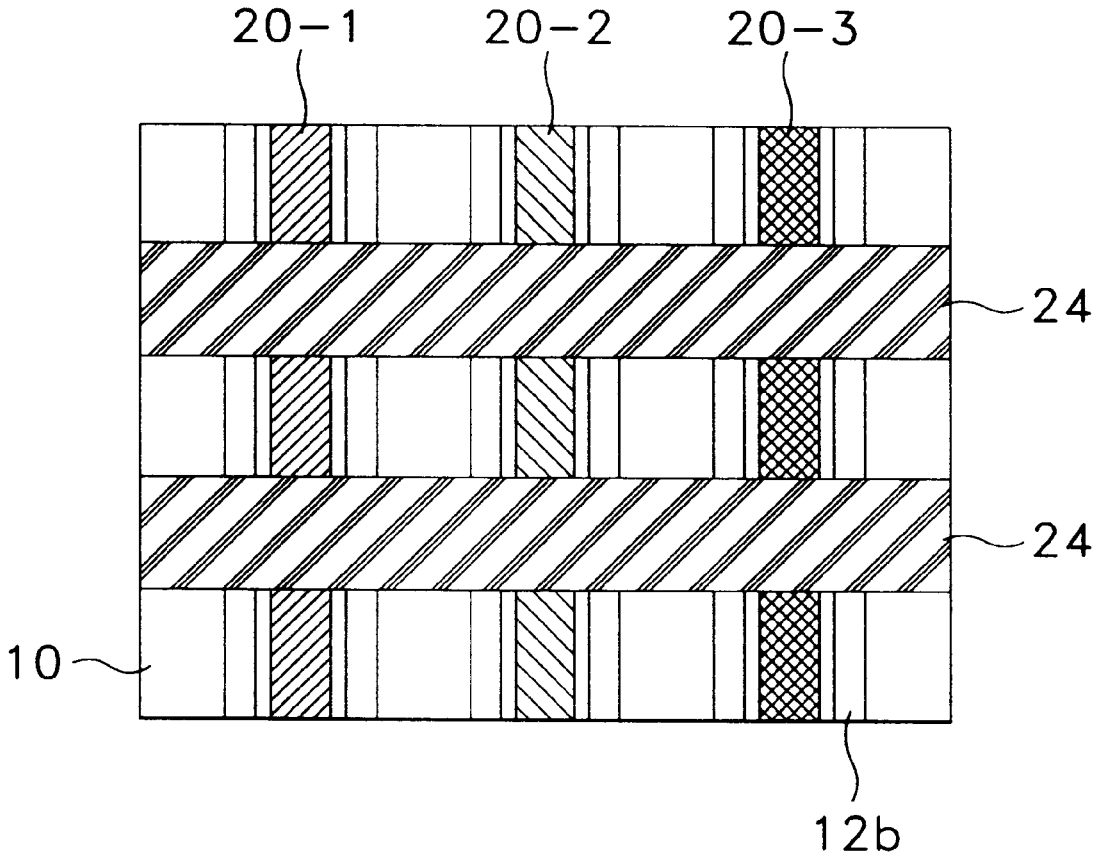
FIG. 3 is a plan view of the plasma display panel formed through the method shown in FIGS. 2A to 2E.

FIG. 3 shows a plan structure of the plasma display panel formed in FIG. 2E without the top transparent substrate. Referring now to FIG. 3, the barrier rib and vertical electrode formed of an identical transparent electrode material are located on the bottom panel 10. Red, green and blue fluorescent layers 20-1, 20-2 and 20-3 are located on the vertical electrodes. The vertical and horizontal electrodes are arranged in perpendicular to each other, having a predetermined distance therebetween, so that a space for gas discharge is obtained between two electrodes. The transparent electrode also serves as the barrier rib. The barrier rib is not warped, in contrast to that formed through the conventional screen printing. Moreover, the method of the present invention results in less damage to the barrier rib during its formation compared to the conventional sand blasting method.

According to the present invention, the transparent vertical electrode consists of two portions of barrier rib and anode. Thus, uniform barrier ribs having flat surfaces can be obtained, removing the crosstalk between the discharged pixels. Furthermore, pixel pitch size can be reduced, resulting in the improvement of the resolution of pictures displayed.

Although the preferred embodiment of the present invention has been disclosed for illustrative purposes, those skilled in the art will appreciate that various modifications, additions and substitutions are possible, without departing from the scope and spirit of the present invention as disclosed in the accompanying claims.

What is claimed is:

1. A method of fabricating a plasma display panel, comprising the steps of:

forming a plurality of first transparent electrode patterns in strip arrangement on a transparent insulating substrate;

selectively etching the first transparent electrode patterns, to form a second transparent electrode patterns each of electrode of which has a groove running along the median of its surface;

forming red, green and blue fluorescent layers on the grooves;

forming a sacrificial layer on the overall surface of the substrate;

forming a through hole in an edge portion of the sacrificial layer, to expose a portion of the substrate;

depositing an electrode material on the overall surface of the sacrificial layer including the through hole so as to sufficiently bury the through hole;

selectively etching the electrode material layer, to form an electrode pattern perpendicular to the second transparent electrode pattern, the electrode pattern including an electrode material portion buried in the through hole; and removing the sacrificial layer.

2. The method as claimed in claim 1, wherein the first transparent electrode pattern is formed through the steps of:

sequentially forming a transparent electrode layer and photoresist layer on the substrate;

forming a first photoresist pattern from the photoresist layer through photolithography;

removing an exposed portion of the transparent electrode layer through dry-etching; and removing the first photoresist pattern.

3. The method as claimed in claim 1, wherein the second transparent electrode pattern is formed through the steps of:

coating a photoresist layer on the first transparent electrode patterns, to sufficiently bury portions existing between the first patterns;

forming a second photoresist pattern from the photoresist layer, to expose the center of the first transparent electrode patterns;

selectively etching the exposed portion of the first transparent electrode patterns through a dry-etching, to thereby form grooves; and removing the second photoresist pattern.

4. The method as claimed in claim 1, wherein the first transparent electrode pattern is etched through a dry-etching using plasma.

5. The method as claimed in claim 1, wherein the sacrificial layer is formed of polyimide.

6. The method as claimed in claim 1, wherein the transparent electrode pattern is formed on ITO.

7. A plasma display panel comprising:

a transparent insulating substrate;

a plurality of transparent electrodes in a strip arrangement with each electrode having a groove that runs along the median of its surface, and side walls on both sides of the groove, the side walls serving as barrier ribs;

a fluorescent layer formed in each groove; and a plurality of electrodes in a strip arrangement having a distance therebetween and perpendicular to the transparent electrodes, the electrodes being supported by supporting means formed on a portion of barrier rib located on the edge portion of the substrate.

8. The plasma display panel as claimed in claim 7, wherein the electrodes and supporting means are formed of an identical material.

9. The plasma display panel as claimed in claim 8, wherein the material is aluminum.

* * * * *